US012660919B1

(12) United States Patent
Wang et al.

(10) Patent No.: US 12,660,919 B1
(45) Date of Patent: Jun. 23, 2026

(54) STACKED STORAGE CABINET

(71) Applicant: Dongguan Fengyi Home Furnishings Co., Ltd., Dongguan (CN)

(72) Inventors: Ronghua Wang, Dongguan (CN); Guangyou Jiang, Dongguan (CN); Binhui Yao, Dongguan (CN)

(73) Assignee: Dongguan Fengyi Home Furnishings Co., Ltd., Dongguan (CN)

( * ) Notice: Subject to any disclaimer, the term of this patent is extended or adjusted under 35 U.S.C. 154(b) by 0 days.

(21) Appl. No.: 19/365,184

(22) Filed: Oct. 22, 2025

(30) Foreign Application Priority Data

Jul. 7, 2025 (CN) ..... 202521414021.8

(51) Int. Cl.
*A47B 87/02* (2006.01)

(52) U.S. Cl.
CPC .. *A47B 87/0292* (2013.01); *A47B 2220/0047* (2013.01); *A47B 2230/02* (2013.01)

(58) Field of Classification Search
CPC ..... A47B 87/0276; A47B 87/0284; A47B 87/0292; A47B 2220/0047; A47B 2230/02
See application file for complete search history.

(56) References Cited

U.S. PATENT DOCUMENTS 3,885,845 A * 5/1975 Krieks ..... A47B 47/042 312/257.1
3,926,529 A * 12/1975 Brooks ..... F16B 12/24 52/285.4
5,666,713 A * 9/1997 Kubota ..... A47B 87/0276 312/111
6,732,858 B1 * 5/2004 Chang Ou ..... A47B 87/0276 220/23.6
6,764,144 B2 * 7/2004 Insalaco ..... A47B 47/00 312/257.1
9,113,706 B1 * 8/2015 Cannon ..... A47B 87/007
9,526,333 B1 * 12/2016 Nielson ..... A47B 87/0292
10,010,170 B2 * 7/2018 Ryner ..... F16B 12/34
12,279,682 B1 * 4/2025 Li ..... A45C 13/03
(Continued)

FOREIGN PATENT DOCUMENTS

CN 104188369 A 12/2014
CN 217090010 U 8/2022
CN 221242067 U 7/2024

*Primary Examiner* — Daniel J Rohrhoff
(74) *Attorney, Agent, or Firm* — Nitin Kaushik

(57) ABSTRACT

The present disclosure discloses a stacked storage cabinet, comprising a plurality of storage cabinet units sequentially stacked along a height direction, wherein every two adjacent storage cabinet units are detachably connected; each storage cabinet unit comprises a bottom plate; a back plate, a bottom of which being detachably provided on the bottom plate; two side plates, bottom side edges of each side plate being detachably provided at two sides of the bottom plate, respectively, longitudinal edges of each side plate being detachably provided at two sides of the back plate, respectively; a fixing strip, two ends of which being detachably connected to each side plate, respectively; cabinet doors, tops of which being rotatably connected with the fixing strip, and bottoms of which being rotatably connected with the bottom plate; and a top cover plate provided on tops of the back plate, the fixing strip and each of the side plates.

8 Claims, 11 Drawing Sheets

(56) References Cited

U.S. PATENT DOCUMENTS

| | | | | |
|---|---|---|---|---|
| 2002/0171332 | A1* | 11/2002 | Skov | F16B 12/02 312/107 |
| 2006/0152114 | A1* | 7/2006 | Yamada | A47B 87/02 312/107 |
| 2008/0042534 | A1* | 2/2008 | Mallouk | A47B 87/0292 312/309 |
| 2008/0122328 | A1* | 5/2008 | Hsu | A47B 47/042 312/297 |
| 2010/0181881 | A1* | 7/2010 | Hsu | A47B 87/0292 312/257.1 |
| 2012/0319547 | A1* | 12/2012 | Moszer | A47B 67/04 312/348.3 |
| 2016/0095430 | A1* | 4/2016 | Moyer | A47B 47/0091 211/188 |
| 2016/0320207 | A1* | 11/2016 | Yokoo | H02P 6/187 |
| 2025/0288095 | A1* | 9/2025 | Clinard | A47B 43/00 |

* cited by examiner

STACKED STORAGE CABINET

CROSS-REFERENCE TO RELATED APPLICATIONS

The application claims priority to Chinese patent application No. 202521414021.8, filed on Jul. 7, 2025, the entire contents of which are incorporated herein by reference.

TECHNICAL FIELD

The present disclosure relates to the technical field of furniture, in particular to a stacked storage cabinet.

BACKGROUND

A storage cabinet is a common type of furniture or equipment that is widely used in a variety of locations such as homes, offices and schools, and its main role is to provide storage space for a user to conveniently sort and store different items.

In some related art, the patent with the patent publication number CN220512462U discloses a plug-in storage cabinet, including a bottom plate and a top plate, four end portions at the front, back, left and right of an upper surface of the bottom plate are provided with slots, respectively, a left side plate and a right side plate are inserted into the slots at the left and right, respectively, flip buttons are hinged to outer side faces of the slots at the left and right, bottoms of outer sides of the left side plate and the right side plate are correspondingly provided with clamping blocks for the flip buttons to be buckled therein in a flipped mode, a door frame is inserted into the slot at a front end, a door plate which can be opened inside and outside is hinged inside the door frame, a rear side plate is inserted into the slot at a rear end, vertical guide grooves are provided at end portions on front and rear sides of the inner side face of the left side plate and the inner side face of the right side plate, respectively, the bottom is inserted into the slot at the front side of the bottom plate after the door frame is inserted from top to bottom along the vertical guide groove at the front side, the bottom is inserted into the slot at the rear side of the bottom plate after the rear side plate is inserted from top to bottom along the vertical guide slot at the rear side, the top plate is buckled to top surfaces of the door frame, the left side plate, the right side plate, and the rear side plate, and the top plate is buckled and fixed through the flip buttons at tops of the left side plate and the right side plate. In the solution, the left side plate and the right side plate are fixed by the slots and the flip buttons, while the door frame is inserted into the bottom plate through the vertical guide grooves, the top plate is fixed to the side plates by the flip buttons, although this connection manner has some stability, is less flexible, and is cumbersome during assembly or disassembly.

In addition, the plug-in storage cabinet is fixed in structure, and its size and shape are difficult to change once assembled, so that it may be necessary to redesign and assemble the entire storage cabinet if it is necessary to increase the storage space.

SUMMARY

To overcome the deficiencies of solutions in the prior art, embodiments of the present disclosure provide a stacked storage cabinet.

A technical solution used by the present disclosure to solve the technical problems is:

A stacked storage cabinet, including a plurality of storage cabinet units stacked sequentially along a height direction, where a detachable connection mechanism is provided between every two adjacent storage cabinet units to achieve detachable stacking fixation of the storage cabinet units in a vertical direction;

each storage cabinet unit includes a bottom plate, a back plate, side plates, a fixing strip, cabinet doors and a top cover plate; a bottom side edge of the back plate is detachably provided on the bottom plate, two side plates are provided, bottom side edges of each of the side plates are detachably provided on two sides of the bottom plate, respectively, longitudinal edges of each of the side plates are detachably provided on two sides of the back plate, respectively, two ends of the fixing strip are detachably connected to each of the side plates, respectively, and the fixing strip is located on the side opposite to the back plate; and tops of the cabinet doors are rotationally connected to the fixing strip, bottoms of the cabinet doors are rotationally connected to the bottom plate, the cabinet doors are rotatable relative to the adjacent side plates, and the top cover plate is provided on tops of the back plate, the fixing strip, and the side plates in a covering mode.

Further, the detachable connection mechanism includes handles, a set of first clasps and a set of second clasps; the first clasps are located at upper side edges of the side plates at a lower layer, and the second clasps are located at lower side edges of the side plates at an upper layer; the first clasps are simultaneously disposed opposite to the adjacent second clasps; and the handles are provided with two hooks, and the hooks are simultaneously threaded to the corresponding first clasps and second clasps.

Further, the handles are integrally formed of elastic materials.

Further, atop of the bottom plate and a bottom of the fixing strip are provided with limiting blocks corresponding to the cabinet doors.

Further, positioning holes pass through the bottom plate; and the back plate is provided with positioning shafts corresponding to the positioning holes, and the positioning shafts are inserted into the positioning holes to fix the bottom plate and the back plate.

Further, a side face of the fixing strip towards the back plate is provided with first supporting blocks, and a side face of the back plate towards the fixing strip is provided with second supporting blocks;

and/or opposite side faces of each of the side plates are provided with a plurality of third supporting blocks.

Further, the bottom plate, the back plate and connecting sides of the fixing strip and the side plates are each provided with fixing holes; a plurality of locking holes correspondingly communicating with the fixing holes respectively pass through each of the side plates; and each storage cabinet unit further includes a plurality of locking pieces, and each of the locking pieces is simultaneously inserted into the corresponding locking holes and fixing holes.

Further, a bottom of the storage cabinet is provided with a plurality of universal wheels.

Compared with the prior art, the present disclosure has the following beneficial effects:

bottom side edges of the back plate are detachably connected with the bottom plate, bottom side edges of each side plate are detachably connected with two sides of the bottom plate, respectively, and longitudinal edges of each side plate are detachably arranged on two sides of the back plate, respectively; two ends of the fixing strip are detachably connected to each side plate, respectively, the cabinet doors are assembled between the fixing strip and the bottom plate, such arrangement enables each component to be disassembled and replaced independently, various components only need to be dissembled or mounted in sequence during the assembly and disassembly, the overall assembly and disassembly process is relatively simple, the complexity of the assembly and disassembly is reduced, and if one of the components is damaged, only the damaged component needs to be replaced, and it is not necessary to replace the entire storage cabinet, thereby reducing maintenance costs.

In the solution, various storage cabinets of the present solution are in a stacked combination manner, and the number of levels of the storage cabinets can be flexibly adjusted, so that a user can conveniently add or remove storage cabinets at any time according to storage needs.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and those of ordinary skill in the art may still derive other accompanying drawings from these accompanying drawings without creative efforts.

NUMERALS IN FIGURES

Figure 1:
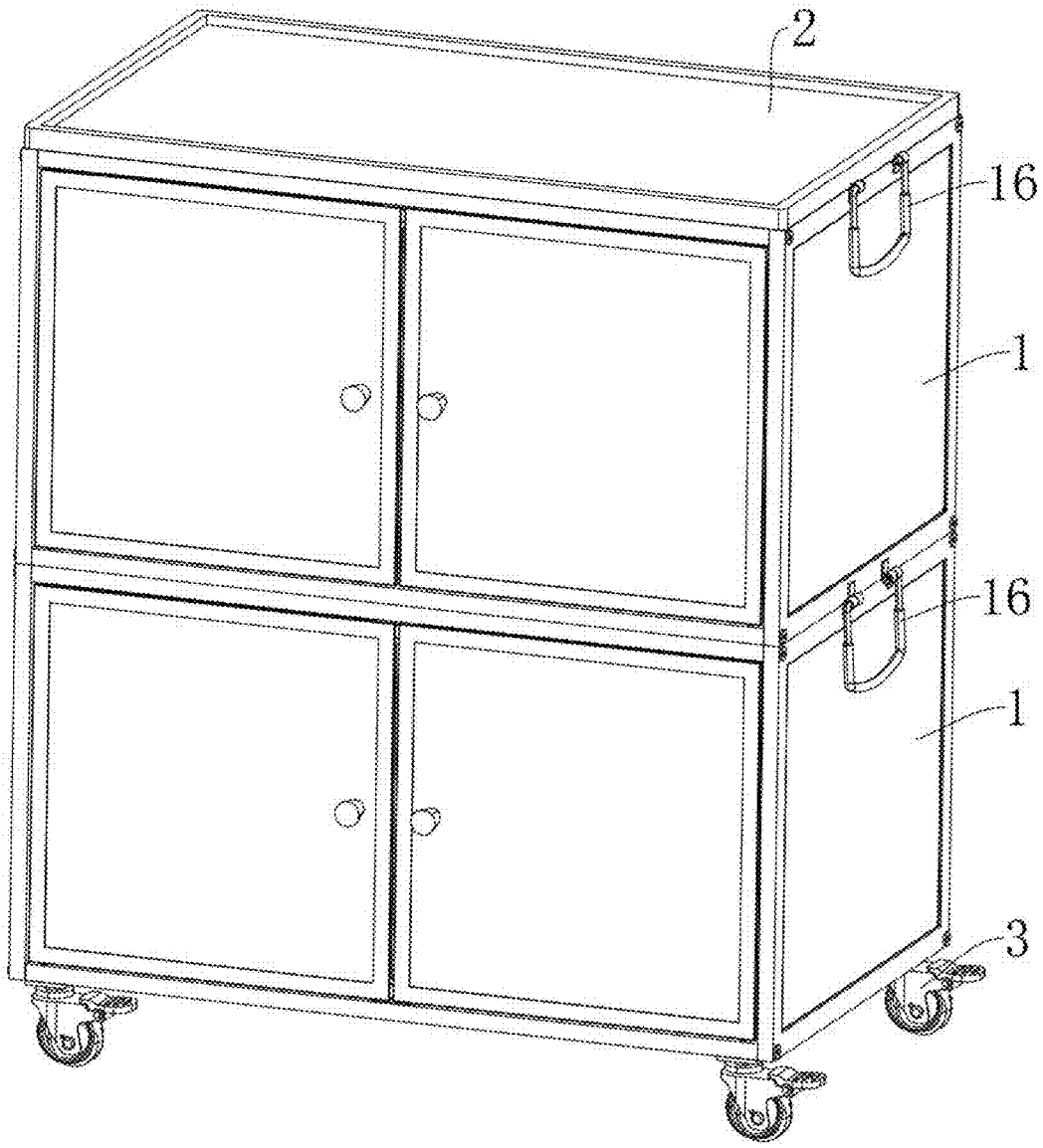
FIG. 1 is a structural diagram according to an embodiment of the present disclosure.
Figure 2:
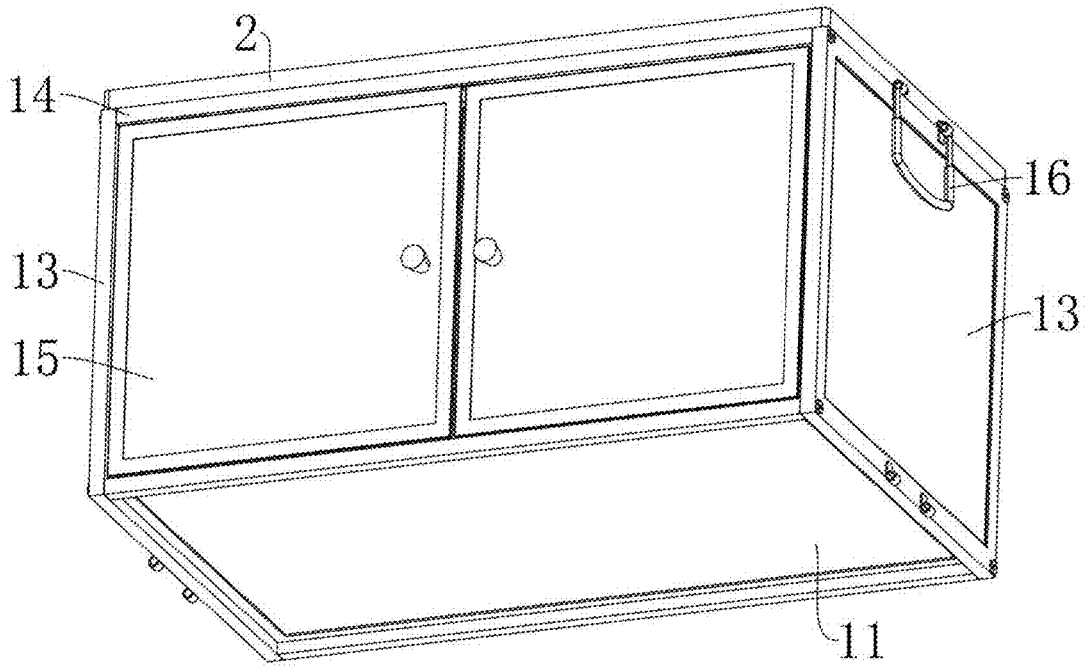
FIG. 2 is a structural diagram of a storage cabinet according to an embodiment of the present disclosure.
Figure 3:
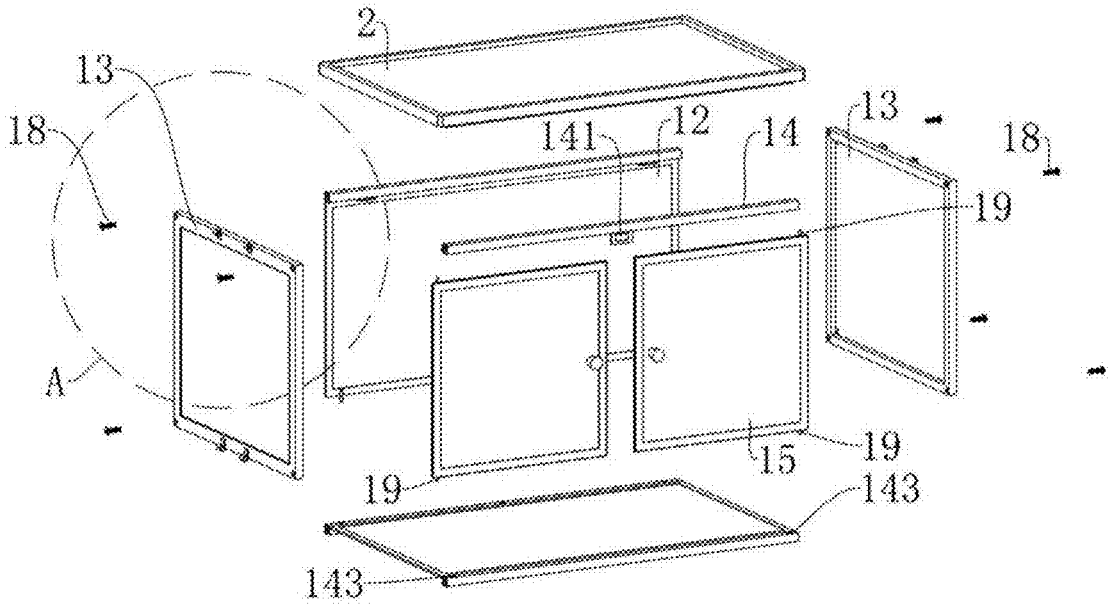
FIG. 3 is an exploded structural diagram of a storage cabinet according to an embodiment of the present disclosure.
Figure 4:
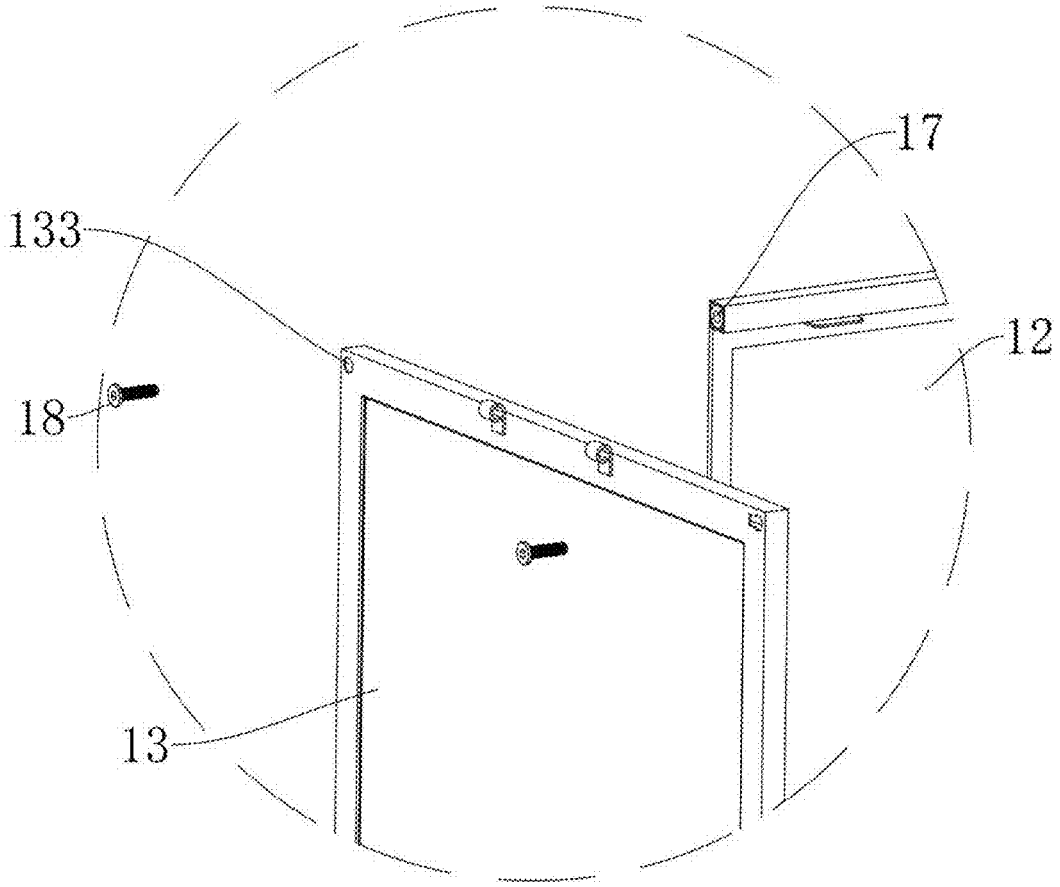
FIG. 4 is a partially enlarged diagram of part Ain FIG. 3.
Figure 5:
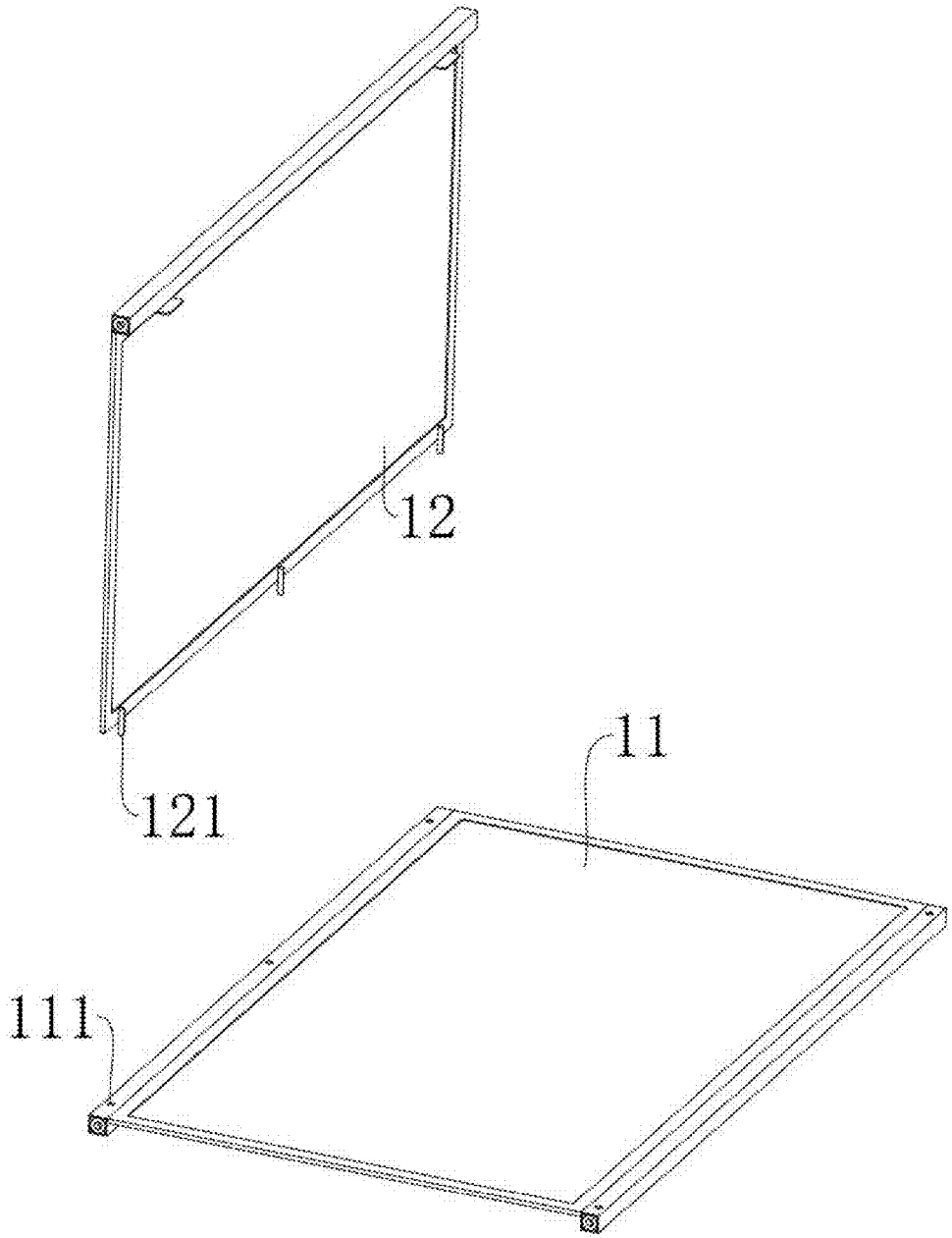
FIG. 5 is an exploded structural diagram of a bottom plate and a back plate according to an embodiment of the present disclosure.
Figure 6:
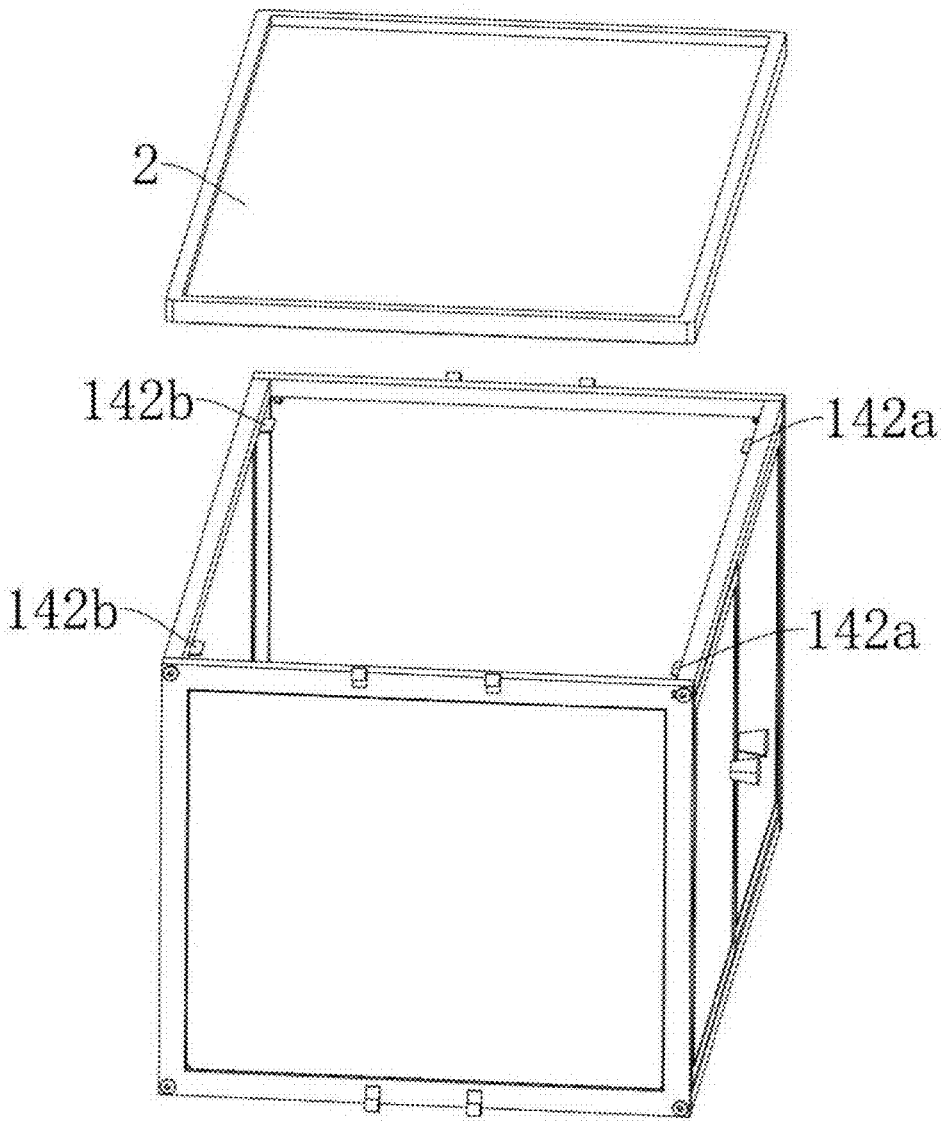
FIG. 6 is a structural diagram of a supporting block according to an embodiment of the present disclosure.
Figure 7:
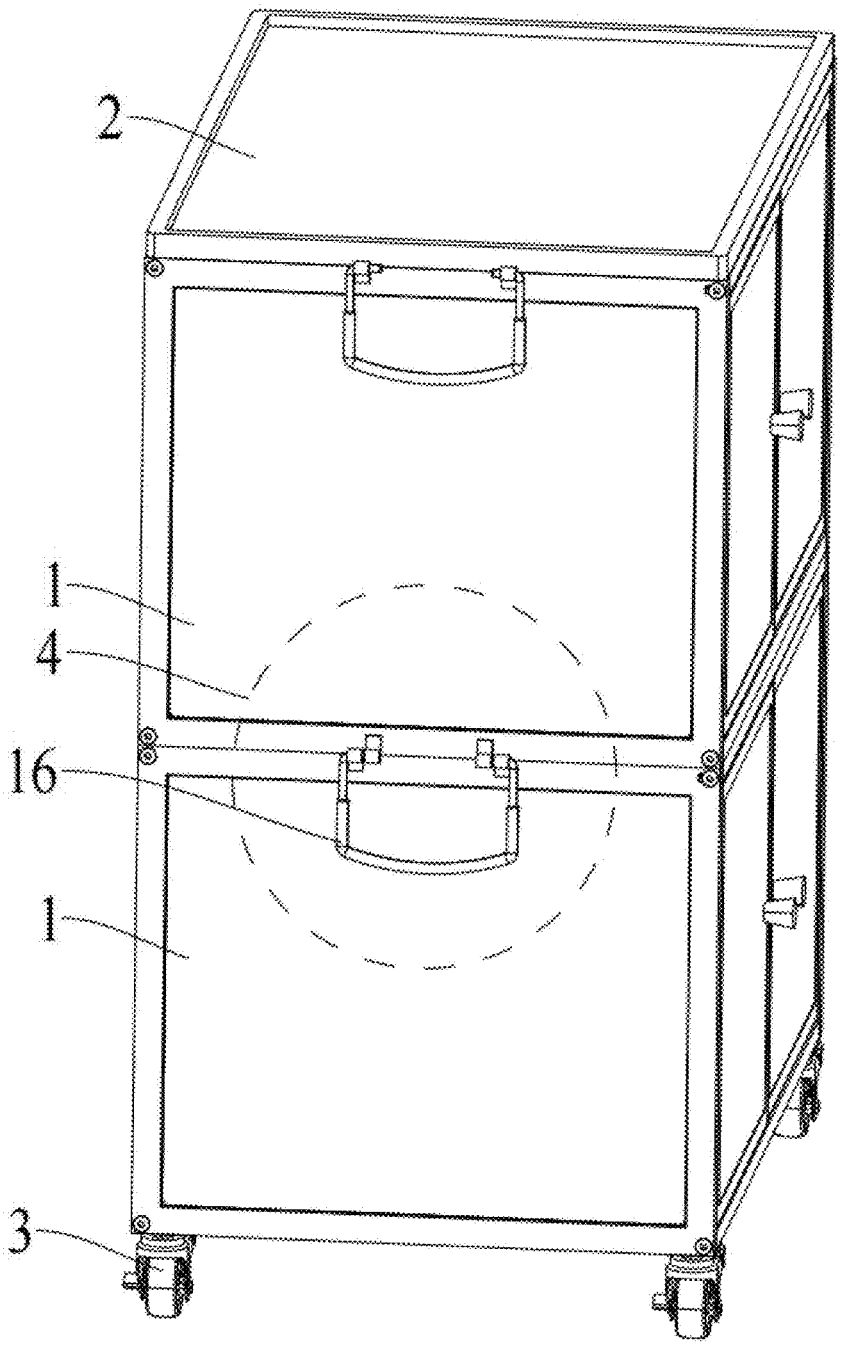
FIG. 7 is a structural diagram of two storage cabinets in a stacked arrangement according to an embodiment of the present disclosure.
Figure 8:
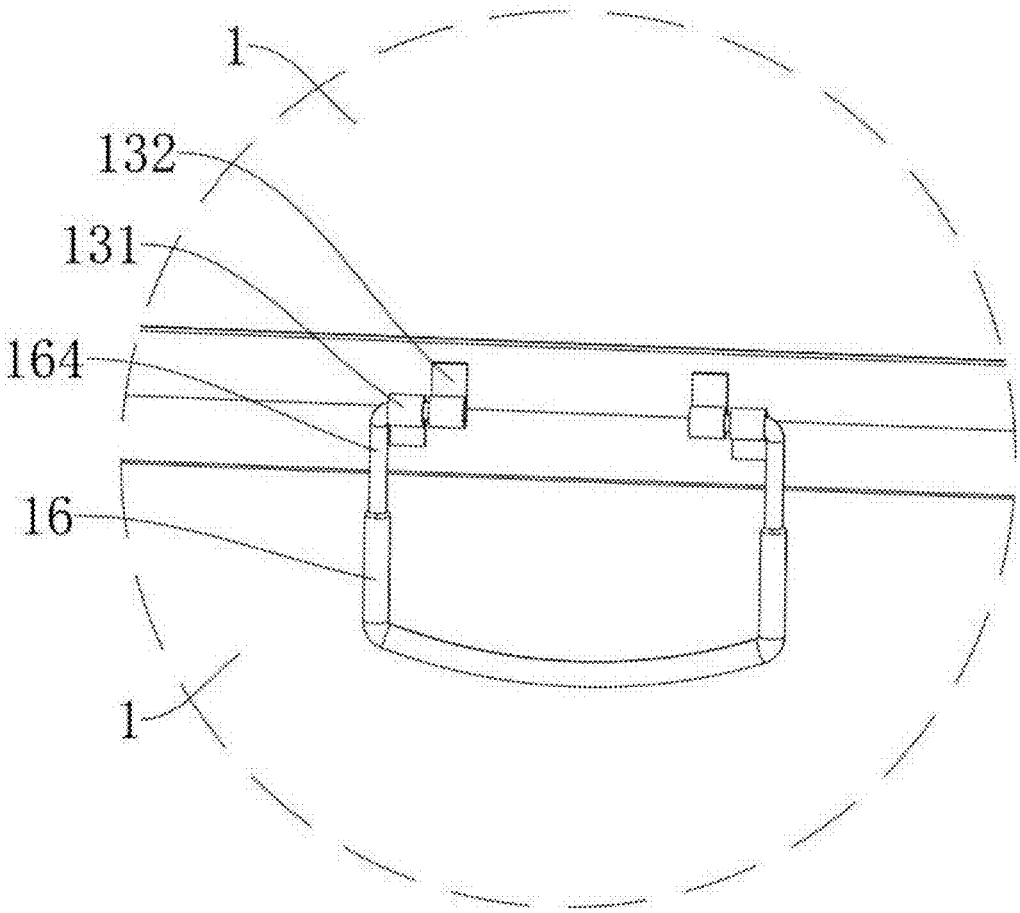
FIG. 8 is a structural diagram of a detachable connection mechanism according to an embodiment of the present disclosure.
Figure 9:
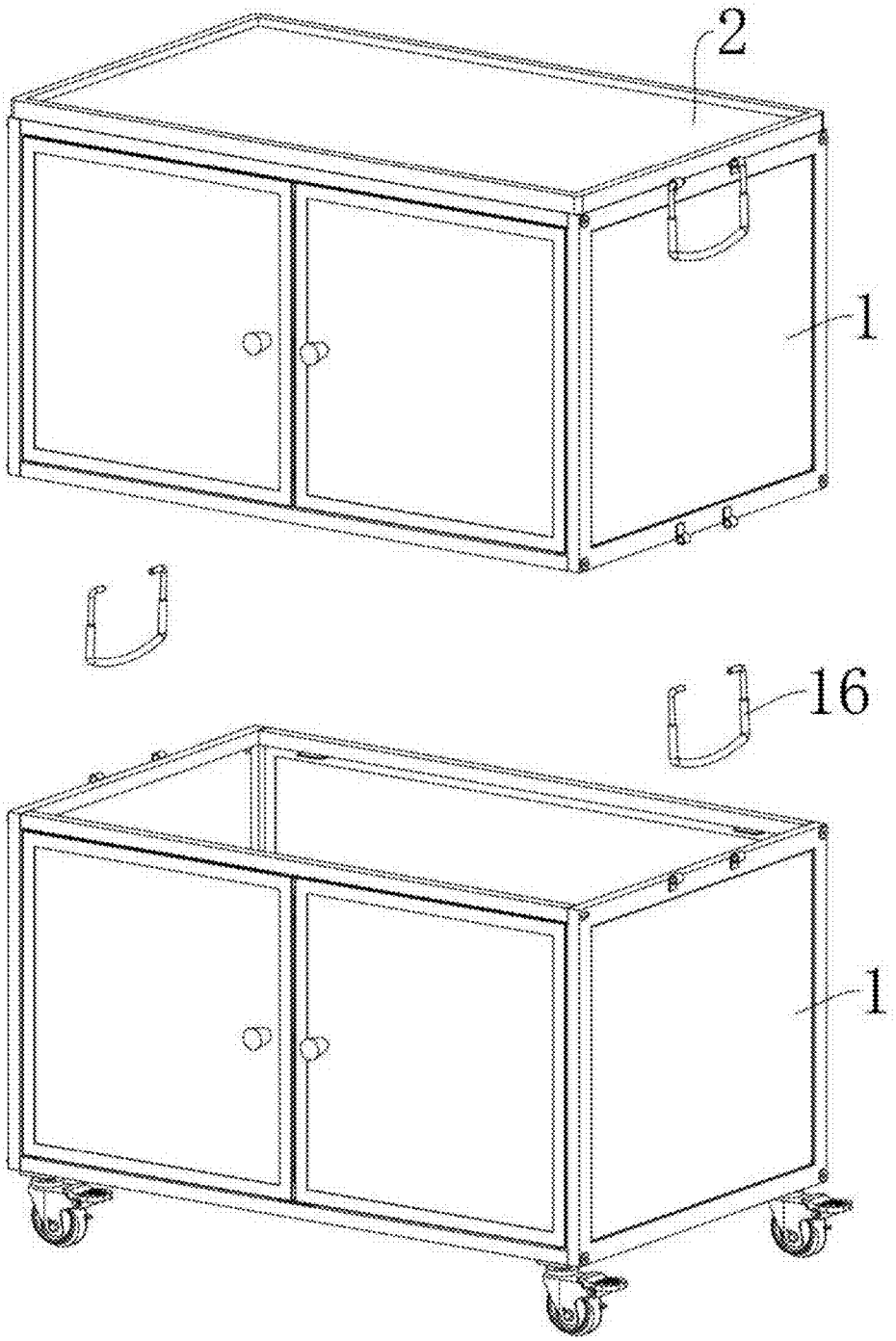
FIG. 9 is an exploded structural diagram of each of the storage cabinets and handles according to an embodiment of the present disclosure.

1—storage cabinet, 11—bottom plate, 111—positioning hole, 12—back plate, 121—positioning shaft, 13—side plate, 131—first clasp, 132—second clasp, 133—locking hole, 14—fixing strip, 141—limiting block, 142*a*—first supporting block, 142*b*—second supporting block, 143—rotating hole, 15—cabinet door, 16—handle, 161—first elastic part, 162—second elastic part, 163—third elastic part, 164—clasp, 17—fixing hole, 18—locking piece, 19—rotating shaft, 2—top cover plate, 3—universal wheel, 4—detachable connection mechanism.

DETAILED DESCRIPTION OF THE EMBODIMENTS

To make the technical problems to be solved, technical solutions, and beneficial effects in the present application clearer and more comprehensible, the following further describes the present application in detail with reference to the accompanying drawings and embodiments.

Embodiments of the present disclosure will now be described in detail below to provide a particular structure of a stacked storage cabinet, as shown in FIGS. 1-11, the stacked storage cabinet includes a plurality of storage cabinet units 1 stacked sequentially along a height direction, where a detachable connection mechanism 4 is provided between every two adjacent storage cabinet units 1 to achieve detachable stacking fixation of the storage cabinet units 1 in a vertical direction; and each storage cabinet unit 1 includes a bottom plate 11, a back plate 12, side plates 13, a fixing strip 14, cabinet doors 15 and a top cover plate 2.

Bottom side edges of the back plate 12 are detachably provided on the bottom plate 11.

In particular, the back plate 12 and the bottom plate 11 are separate components, and the two are detachably separated to facilitate transportation.

Two side plates 13 are provided, bottom side edges of each side plate 13 are detachably provided on two sides of the bottom plate 11, respectively; and longitudinal edges of each side plate 13 are detachably provided on two sides of the back plate 12, respectively.

In particular, each side plate 13 and the bottom plate 11 are separate components, i.e. each side plate 13 and the bottom plate 11 are detachably separated into separate components. When the assembly is required, the bottom plate 11 is placed flatly to ensure that it is smooth and level; positioning shafts 121 at the bottom of the back plate 12 are subsequently aligned with mounting positions of positioning holes 111 at a top of the bottom plate 11; various side plates 13 are subsequently placed on two sides of the bottom plate 11, respectively, i.e., after the bottom of a first side plate 13 is aligned with a mounting position on one side of the bottom plate 11 and the rear of the first side plate 13 is aligned with a mounting position on one side of the back plate 12 at the same time, the assembly can be performed to fix the first side plate 13; and the assembly principle of a second side plate 13 is identical to that of the first side plate 13, and the specific assembly process is not explained here too much.

Two ends of the fixing strip 14 are detachably connected to various side plates 13, respectively, and the fixing strip 14 is located on the side opposite to the back plate 12.

In particular, during the assembly, when the bottom of the back plate 12 is connected with the top of the bottom plate 11, after the bottoms of various side plates 13 are connected with two sides of the bottom plate 11, respectively, and at the same time, the rear portions of various side plates 13 are connected with two sides of the back plate 12, respectively, at this time, the two ends of the fixing strip 14 are aligned with mounting positions of the two side plates 13, respectively, and the assembly is completed, such that the fixing strip 14 is fixed; this structure facilitates stable supporting for the subsequent assembly of the cabinet doors 15; and in addition, if the fixing strip 14 needs to be replaced or disassembled, only various side plates 13 need to be disassembled, and the entire fixing strip 14 can be taken out after various side plates 13 are separated from the fixing strip 14.

The tops of the cabinet doors 15 are rotatably connected to the fixing strip 14, the bottoms of the cabinet doors 15 are rotatably connected to the bottom plate 11, and the cabinet doors 15 are rotatable relative to the adjacent side plates 13.

In particular, the fixing strip 14 and the bottom plate 11 are used for supporting and fixing the whole cabinet doors 15, if the entire cabinet doors 15 need to be disassembled, since the tops of the cabinet doors 15 are connected to the bottom of the fixing strip 14, the fixing strip 14 is disassembled and taken out from various side plates 13 first, after the fixing strip 14 is disassembled and taken out, the tops of the cabinet doors 15 are separated from the fixing strip 14 at this time, the entire cabinet doors 15 can be subsequently disassembled from the bottom plate 11, and the entire cabinet doors 15 are taken out. Conversely, when the cabinet doors 15 are assembled, the bottoms of the cabinet doors 15 are first aligned with designated mounting positions of the bottom plate, and fixedly assembled to connecting positions of the bottom plate 11, the tops of the cabinet doors 15 are subsequently aligned with the mounting positions of the fixing strip 14, since the tops of the cabinet doors 15 are detachably connected to the fixing strip 14, it is necessary to find its mounting positions and firmly connect them to the bottom of the fixing strip 14, finally, after the two ends of the fixing strip 14 are aligned with the mounting positions of the side plates 13, respectively, the two ends of the fixing strip 14 are fixedly connected to the mounting positions of various side plates 13, respectively, and the assembly of the cabinet doors 15 is completed at this time.

It can be understood that the tops and bottoms of the cabinet doors 15 of the embodiment of the present disclosure are both provided with rotating shafts 19, that is, the cabinet doors 15 are inserted into rotating holes 143 at the bottom of the fixing strip 14 and the top of the bottom plate 11 through various rotating shafts 19, respectively; for example, at the time of assembly, only the rotating shafts 19 of the cabinet doors 15 need to be inserted directly into the rotating holes 143 at the bottom of the fixing strip 14; conversely, at the time of disassembly, only the rotating shafts 19 of the cabinet doors 15 need to be away from the rotating holes 143 at the bottom of the fixing strip 14, and such arrangement is achieved, thereby achieving quick disassembly and assembly of the cabinet doors 15.

It is to be noted that since the cabinet doors 15 achieve rotation relative to the adjacent side plates 13 by means of the rotating shafts, when items need to be placed, the cabinet doors 15 are rotated by means of the rotating shafts until a cabinet cavity in the storage cabinet can be opened, and the items can be placed in the cabinet cavity at this time.

The top cover plate 2 is provided on the top of the back plate 12, the top of the fixing strip 14 and the tops of various side plates 13 in a covering mode.

In particular, when the storage cabinet units 1 are assembled, the bottom of the back plate 12 is aligned with a mounting position on the top of the bottom plate 11, and the back plate 12 is firmly assembled onto the bottom plate 11; the bottom of a first side plate 13 is subsequently aligned with the mounting position on one side of the bottom plate 11, meanwhile, the rear of the side plate 13 is aligned with the mounting position on one side of the back plate 12, and the side plate 13 is firmly assembled to the bottom plate 11 and the back plate 12, ensuring that the side plate 13 can be fixed to the bottom plate 11 and the back plate 12; the assembly of the second side plate 13 is the same as that of the first side plate 13 and will not be described in more detail here; the bottoms of the cabinet doors 15 are aligned with mounting positions at the top of the bottom plate 11, and the cabinet doors are firmly assembled to the bottom plate 11; the fixing strip 14 is then aligned with the mounting positions at the tops of the cabinet doors 15 and the fixing strip 14 is firmly assembled to the tops of the cabinet doors 15, and meanwhile, the two ends of the fixing strip 14 are connected to various side plates 13, respectively; and finally, the assembly of the entire storage cabinet units 1 is completed after the top cover plate 2 is placed directly on the top of the back plate 12, the top of the fixing strip 14 and the tops of various side plates 13.

When the storage cabinet units 1 are disassembled, the disassembly of the components only needs to be done in a reverse order of the assembly, and the specific process is not described in more detail here.

If transportation is required, by disassembling and taking out each component separately, it is possible to avoid the inconvenience caused by the large size of the storage cabinet units 1 during transportation; and in addition, if one of the components is damaged by impact of an external force, moisture and other reasons, the entire storage cabinet needs not be disassembled, and the damaged component can be replaced by disassembling it separately.

In some specific embodiments, a plurality of storage cabinet units 1 are provided, various storage cabinet units 1 are stacked, and adjacent storage cabinet units 1 may be detachably stacked and fixed.

In particular, by stacking a plurality of storage cabinet units 1, vertical space can be fully utilized, particularly in environments where the space is limited (such as small apartments, offices or narrow hallways). By means of this solution, it is possible to make maximum use of the height, thereby providing more storage space without taking up excessive floor area.

Furthermore, due to the detachable connection between the storage cabinet units 1, the number of storage cabinet units 1 can be increased or decreased at any time depending on the actual requirements. For example, if more storage space is required, one storage cabinet unit 1 can be added and assembled on the top of the storage cabinet unit 1 at a lower layer; conversely, if space is insufficient or the storage demand is reduced, excessive storage cabinet units 1 can be disassembled, so that various storage cabinet units 1 can be flexibly added or removed, and the storage cabinet units 1 can adapt to different usage scenarios and demand changes.

It is to be noted that, except for the storage cabinet unit 1 at the topmost layer and the storage cabinet unit 1 at the bottommost layer, the bottom plates 11 of the remaining storage cabinet units 1 are located above the adjacent storage cabinet units 1, so that only one top cover plate 2 has to be placed on the top of the storage cabinet unit 1 at the topmost layer, and such arrangement can simplify the structure of the entire storage cabinet units 1 without the need for each storage cabinet unit 1 to be equipped with a separate top cover plate 2.

According to FIGS. 7-10, in a further embodiment, the detachable connection mechanism 4 includes a set of (two) first clasps 131 and a set of (two) second clasps 132; the first clasps 131 are located at the upper side edges of the side plates 13 at the lower layer, and the second clasps 132 are located at the lower side edges of the side plates 13 at the upper layer; the first clasps 131 are respectively disposed opposite to the adjacent second clasps 132; the storage cabinet unit 1 further includes handles 16, the handles 16 are provided with two hooks 164, and various hooks 164 pass through the corresponding first clasps 131 and second clasps 132 at the same time.

In particular, two first clasps 131 and two second clasps 132 are provided on the side plates 13 of each storage cabinet unit 1, the first clasps 131 and the second clasps 132 are respectively located at different positions of the side plates 13, for example, the first clasps 131 are located above the second clasps 132, when two storage cabinet units 1 are placed in a stacked mode, the first clasps 131 of one of the storage cabinet units 1 are disposed opposite to the second clasps 132 of the adjacent storage cabinet unit 1, when hooks 164 of the handles 16 may pass through the corresponding first clasps 131 and second clasps 132 at the same time, the hooks 164 are firmly inserted between the first clasps 131 and the second clasps 132, sufficient fixing force can be provided after insertion to prevent loosening of the handles 16, and two storage cabinet units 1 can be brought into close abutment with each other, and this connection manner is not only easier to assemble, but also effectively prevents shifting or tipping of the storage cabinet units 1 when stacked.

It is to be noted that, button holes pass through both the first clasps 131 and the second clasps 132 of the embodiment of the present disclosure, when two storage cabinet units 1 are placed in a stacked mode, button holes of the first clasps 131 will be aligned with button holes of the second clasps 132 of the adjacent storage cabinet unit 1, since the shape and size of the hooks 164 match those of the button holes of the clasps to ensure that the hooks can be inserted smoothly into the button holes, in this way, the side plates 13 of two storage cabinet units 1 are tightly secured together by the handles 16 after the hooks 164 of the handles 16 are inserted into the button holes of the first clasps 131 and the second clasps 132 at the same time, and the storage cabinet unit 1 at the upper layer can withstand certain external force by abutting two stacked storage cabinet units 1, making it difficult to shift or dump.

In some specific embodiments, the handles 16 are integrally formed from elastic materials; for example, made of thermoplastic elastomers (TPEs).

Figure 10:
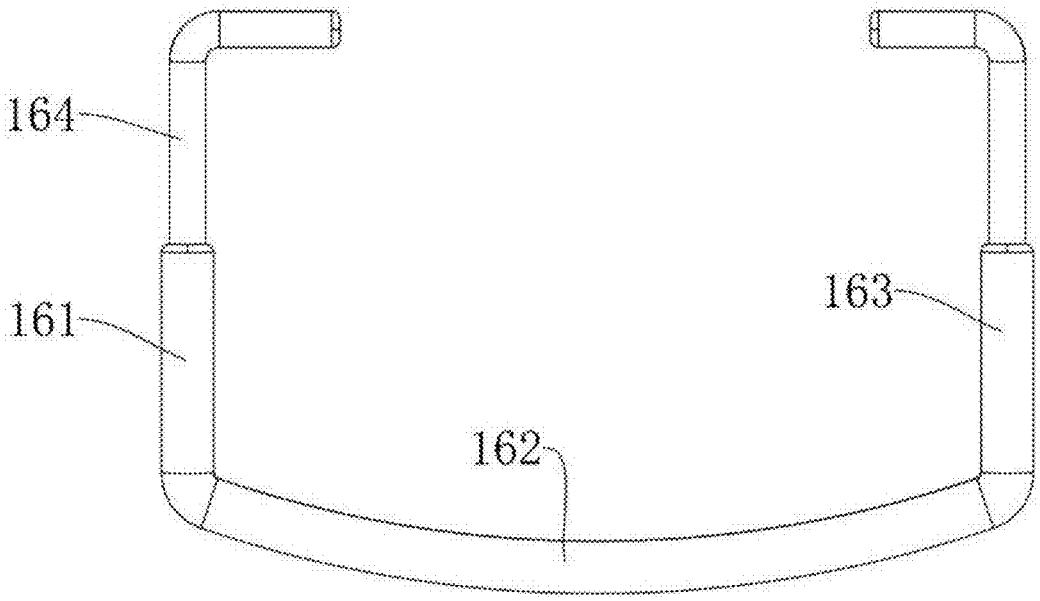
FIG. 10 is a structural diagram of a handle according to an embodiment of the present disclosure.
Figure 11:
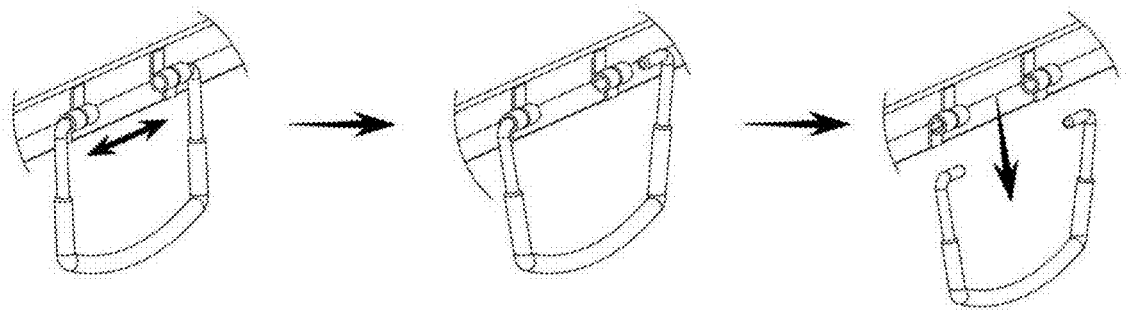
FIG. 11 is a structural diagram showing using conditions of the handle according to the embodiment of the present disclosure.

As shown in FIGS. 10-11, it can be understood that the handles 16 are U-shaped; each handle 16 includes a first elastic part 161, a second elastic part 162 and a third elastic part 163 connected in sequence; and various hooks 164 are provided at one end of the first elastic part 161 and one end of the third elastic part 163, respectively.

In particular, since the handles 16 are U-shaped as a whole and are each formed by the first elastic part 161, the second elastic part 162 and the third elastic part 163 connected in sequence, this shape allows the handles 16 to have certain elasticity and flexibility; referring to FIG. 11, if two storage cabinet units 1 need to be placed in a stacked mode, the first clasps 131 at this time are disposed opposite to the corresponding second clasps 132, the first elastic part 161 and the third elastic part 163 are subsequently snapped with a finger simultaneously to move the first elastic part 161 and the third elastic part 163 away from each other, at this time, elastic rods are elastically deformed to move the two hooks 164 away from each other to a specified distance, and the hooks 164 are subsequently aligned with first clasps 131 and the second clasps 132; when the first elastic part 161 and the third elastic part 163 are released simultaneously, due to the elastic properties of the elastic rods, automatic restoring to original states can be achieved, the first elastic part 161 and the third elastic part 163 restore to original states, in the process, the hooks 164 are simultaneously inserted into the corresponding first clasps 131 and second clasps 132, respectively, by means of the restoring force of the elastic rods to secure the two storage cabinet units 1 in abutment with each other.

In some specific embodiments, the top of the bottom plate 11 and the bottom of the fixing strip 14 are provided with limiting blocks 141 corresponding to the cabinet doors.

In particular, when the cabinet doors 15 are rotated to simultaneously abut against each limiting block 141, further rotation of the cabinet doors 15 is prevented by limiting the cabinet doors 15 in designated positions through the plurality of limiting blocks 141, thereby preventing the cabinet doors 15 from rotating into the interior of the cabinet cavity. In everyday use, by rotating the cabinet doors 15 to closing directions, the edges of the cabinet doors 15 gradually approach the limiting blocks 141 as the cabinet doors 15 are rotated, and the cabinet doors 15 are rotated to the edges of the cabinet doors 15 to abut against the limiting blocks 141. At this time, further rotation of the cabinet doors 15 is prevented by the limiting blocks 141, and the stopping effect of the limiting blocks 141 prevents continued rotation of the cabinet doors 15 in the closing directions, thereby ensuring that the cabinet doors 15 are in the closed positions exactly.

In some specific embodiments, positioning holes 111 pass through the bottom plate 11; and the back plate 12 is provided with positioning shafts 121, and the positioning shafts 121 are inserted inside the positioning holes 111.

In particular, the number and position of the plurality of positioning shafts 121 of the back plate 12 correspond to those of the positioning holes 111 of the bottom plate 11, the positioning shafts 121 are located near the bottom of the back plate 12 for matching the positioning holes 111 of the bottom plate 11, i.e., various positioning shafts 121 are inserted into various positioning hole 111, respectively, for achieving a positioning effect on the assembly of the back plate 12. Specifically, when the back plate 12 is assembled, the back plate 12 is first placed above the bottom plate 11, ensuring that the positioning shafts 121 of the back plate 12 are aligned with the positioning holes 111 of the bottom plate 11; the back plate 12 is subsequently slowly moved downwards until the positioning shafts 121 are inserted into the positioning holes 111, after the positioning shafts 121 are inserted into the positioning holes 111, the relative positions between the back plate 12 and the bottom plate 11 are fixed, by this positioning manner, it is possible to ensure that the back plate 12 can be accurately placed at a designated position during the assembly, and the condition that the back plate 12 is wobbled or displaced during the assembly is prevented.

It can be understood that the shape and size of the positioning holes 111 of the embodiment of the present disclosure match those of the positioning shafts 121 to ensure that the positioning shafts 121 can be smoothly inserted and stably fixed inside the positioning holes 111. For example, the positioning holes 111 are circular holes, and the positioning shafts 121 are cylindrical.

In some specific embodiments, a side face of the fixing strip 14 towards the back plate 12 is provided with first supporting blocks **142*a*, and a side face of the back plate 12 towards the fixing strip 14 is provided with second supporting blocks 142*b***.

In particular, in order to ensure that the top cover 2 can be stably placed on the top of the storage cabinet unit 1, a plurality of stable supporting points are thus provided by the first supporting blocks **142*a* and the second supporting blocks 142*b*, thereby enabling the weight of the top cover plate 2 to be evenly carried, so that the weight of the top cover plate 2** can be commonly borne by the plurality of supporting points, thereby reducing the burden on each supporting point.

In some other embodiments, the opposite side faces of each side plate 13 are provided with a plurality of third supporting blocks, the principle of which is similar to that of the previous solution and will not be repeated here.

In some specific embodiments, two sides of the bottom plate 11, two sides of the back plate 12 and two sides of the fixing strip 14 are provided with fixing holes 17; a plurality of locking holes 133 correspondingly communicating with various fixing holes 17 pass through various side plates 13, respectively; and the storage cabinet further includes a plurality of locking pieces 18, and various locking pieces 18 are simultaneously inserted into corresponding locking holes 133 and fixing holes 17.

In particular, the number and position of various fixing holes 17 at the two sides of the bottom plate 11, the two sides of the back plate 12 and the fixing strip 14 are in one-to-one correspondence with the locking holes 133 at the side plates 13, respectively, to ensure that the side plate 13 can be accurately connected to each component, and when the storage cabinet units 1 need to be disassembled, the side plate 13 can be separated from the bottom plate 11, the back plate 12 or the fixing strip 14 by simply screwing or unscrewing the locking pieces 18 from the locking holes 133 and the fixing holes 17; and conversely, when the storage cabinet units 1 are installed, the locking pieces 18 are inserted into the corresponding locking holes 133 and fixing holes 17 and screwed or fixed, thereby firmly connecting the side plates 13 to various components.

By way of example, during the assembly, by aligning the bottoms of various side plates 13 to two sides of the bottom plate 11, respectively, the rear portions of various side plates 13 are simultaneously aligned to two sides of the back plate 12, respectively, ensuring that various locking holes 133 of the side plates 13 can be aligned with the fixing holes 17 of the bottom plate 11 and the back plate 12 in a one-to-one mode, the locking holes 133 at two ends of the fixing strip 14 are subsequently aligned with the fixing holes 17 of various side plates 13, respectively, finally the locking pieces 18 are simultaneously inserted into the corresponding locking holes 133 and the fixing holes 17, respectively, and the locking pieces 18 are sequentially screwed to ensure that the side plates 13 can be fixedly connected with the fixing strip 14, the back plate 12 and the bottom plate 11. During the disassembly, various side plates 13 can be separated from the fixing strip 14, the back plate 12 and the bottom plate 11 by sequentially loosening and removing the locking pieces 18.

It can be understood that the locking pieces 18 of the embodiment of the present disclosure are screws, and various fixing holes 17 are screw holes.

In some specific embodiments, the bottom of the storage cabinet is provided with a plurality of universal wheels 3.

In particular, easy movement of the entire storage cabinet on the ground is achieved by means of a plurality of universal wheels 3, since the universal wheels 3 are able to rotate by 360 degrees, the whole storage cabinet can be moved on the ground only by gently pushing the storage cabinet without lifting or tilting the storage cabinet, thereby quickly adjusting the position of the storage cabinet, and thus being adapted to using environments where frequent adjustment of the storage cabinet position is required.

It is to be noted that for a plurality of storage cabinet units 1 arranged in a stacked mode, it is only necessary to assemble the universal wheels 3 to the bottom of the storage cabinet unit 1 at the lowermost layer.

The above description is only specific implementations of the present disclosure, but the protection scope of the present disclosure is not limited thereto, and various equivalent modifications or substitutions can be easily conceived by those skilled in the art within the technical scope of the present disclosure, and these modifications or substitutions should be covered in the protection scope of the present disclosure. Therefore, the scope of protection of the present disclosure shall be subject to the scope of protection of the appended claims.

What is claimed is:

1. A stacked storage cabinet, comprising a plurality of storage cabinet units stacked sequentially along a height direction, wherein a detachable connection mechanism is provided between every two adjacent storage cabinet units to achieve detachable stacking fixation of the storage cabinet units in a vertical direction;

each storage cabinet unit comprises a bottom plate, a back plate, side plates, a fixing strip and cabinet doors; a bottom side edge of the back plate is detachably provided on the bottom plate, two side plates are provided, bottom side edges of each of the side plates are detachably provided on two sides of the bottom plate, respectively, longitudinal edges of each of the side plates are detachably provided on two sides of the back plate, respectively, two ends of the fixing strip are detachably connected to each of the side plates, respectively, and the fixing strip is located on a side opposite to the back plate; and tops of the cabinet doors are rotationally connected to the fixing strip, bottoms of the cabinet doors are rotationally connected to the bottom plate, the cabinet doors are rotatable relative to the adjacent side plates;

wherein a top cover plate is provided on tops of the back plate, the fixing strip, and the side plates of a topmost storage cabinet unit of the plurality of storage cabinet units in a covering mode;

wherein the detachable connection mechanism comprises handles, a set of first clasps and a set of second clasps; the first clasps are located at upper side edges of the side plates at a lower layer, and the second clasps are located at lower side edges of the side plates at an upper layer; and the first clasps are respectively disposed opposite to the adjacent second clasps; and the handles are provided with two hooks, and the hooks are simultaneously threaded to the corresponding first clasps and second clasps.

2. The stacked storage cabinet according to claim 1, wherein the handles are integrally formed from elastic materials.

3. The stacked storage cabinet according to claim 1, wherein a top of the bottom plate and a bottom of the fixing strip are provided with limiting blocks corresponding to the cabinet doors.

4. The stacked storage cabinet according to claim 1, wherein positioning holes pass through the bottom plate; and the back plate is provided with positioning shafts corresponding to the positioning holes, and the positioning shafts are inserted into the positioning holes to fix the bottom plate and the back plate.

5. The stacked storage cabinet according to claim 1, wherein a side face of the fixing strip towards the back plate is provided with first supporting blocks, and a side face of the back plate towards the fixing strip is provided with second supporting blocks.

6. The stacked storage cabinet according to claim 1, wherein opposite side faces of each of the side plates are provided with a plurality of third supporting blocks.

7. The stacked storage cabinet according to claim 1, wherein the bottom plate, the back plate and connecting sides of the fixing strip and the side plates are each provided with fixing holes; a plurality of locking holes correspondingly communicating with the fixing holes respectively pass through each of the side plates; and each storage cabinet unit further comprises a plurality of locking pieces, and each of the locking pieces are simultaneously inserted into the corresponding locking holes and fixing holes.

8. The stacked storage cabinet according to claim 1, wherein the bottom of the storage cabinet is provided with a plurality of universal wheels.

* * * * *